US008306234B2

(12) United States Patent
Christoph et al.

(10) Patent No.: US 8,306,234 B2
(45) Date of Patent: Nov. 6, 2012

(54) SYSTEM FOR IMPROVING COMMUNICATION IN A ROOM

(75) Inventors: Markus Christoph, Straubing (DE); Tim Haulick, Blaubeuren (DE); Gerhard Schmidt, Ulm (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 1459 days.

(21) Appl. No.: 11/753,255

(22) Filed: May 24, 2007

(65) Prior Publication Data

US 2008/0031468 A1 Feb. 7, 2008

(30) Foreign Application Priority Data

May 24, 2006 (EP) ..... 06010757

(51) Int. Cl.
*H04R 5/00* (2006.01)

(52) U.S. Cl. ..... 381/17; 381/86; 381/83; 381/93; 381/71.1; 381/71.2; 381/71.4

(58) Field of Classification Search ..... 381/302, 381/86, 71.1–71.5, 17, 83, 93
See application file for complete search history.

(56) References Cited

U.S. PATENT DOCUMENTS

| | | | | |
|---|---|---|---|---|
| 2,983,790 | A | 5/1961 | Olson | 179/1 |
| 4,965,833 | A | 10/1990 | McGregor et al. | 381/83 |
| 5,544,201 | A * | 8/1996 | Hoshino et al. | 375/350 |
| 5,796,819 | A | 8/1998 | Romesburg | 379/406 |
| 6,363,156 | B1 * | 3/2002 | Roddy | 381/86 |
| 6,496,581 | B1 | 12/2002 | Finn et al. | 379/406.01 |
| 6,535,609 | B1 | 3/2003 | Finn et al. | 381/86 |
| 6,980,663 | B1 | 12/2005 | Linhard | 381/86 |
| 7,039,197 | B1 | 5/2006 | Venkatesh et al. | 381/86 |
| 7,050,593 | B1 * | 5/2006 | Emerling et al. | 381/86 |
| 2002/0076059 | A1 * | 6/2002 | Joynes | 381/71.6 |
| 2005/0265560 | A1 | 12/2005 | Haulick et al. | 381/58 |
| 2006/0023892 | A1 | 2/2006 | Schultz | 381/58 |

FOREIGN PATENT DOCUMENTS

| | | | |
|---|---|---|---|
| DE | 655 508 | 12/1937 | 21/16 |
| DE | 19938171 | 3/2001 | 15/2 |
| WO | WO 01/41499 A2 | 6/2001 | |

OTHER PUBLICATIONS

Hänsler et al., "Acoustic Echo and Noise Control," John Wiley & Sons, New York, 2004.
Helmut Haas, "The Influence of a Single Echo on the Audibility of Speech," Journal of the Audio Engineering Society, vol. 20, No. 2, pp. 146-159, Mar. 1972.

(Continued)

*Primary Examiner* — Devona E. Faulk
*Assistant Examiner* — Disler Paul
(74) *Attorney, Agent, or Firm* — O'Shea Getz P.C.

(57) ABSTRACT

Improving the acoustical communication between interlocutors in at least two positions in a room includes generating electrical signals representative of acoustical signals present at the respective interlocutor positions, amplifying each of the electrical signals and converting the amplified electrical signals into acoustical signals. A time delay is applied to the electrical signals such that the acoustical signal arriving first at one of the interlocutor positions originates from the direction of the other interlocutor position.

23 Claims, 5 Drawing Sheets

OTHER PUBLICATIONS

Meyer et al., Über den Einfluss con Schallrückwürfen auf Richtungslokalisation and Lautstärke bei Sprache [The effect of sound reflection on directional localization and volume in speech], Nachrichten der Akademie der Wissenschaften in Göttingen, Math-phys. Cl. 6, pp. 31-42, 1952.
Schmidt et al., "Enthallung der Wiedergabe von Audiosignalen in Fahrzeugen mit Insassenkommunikationsanlagen," Notification of Invention P05051, Jan. 2005.
Kuo et al., "Active Noise Control Systems: Algorithms and DSP Implementations," John Wiley & Sons, Inc., New York 1996, pp. 1-5.
Harry F. Olson, "Electronic Control of Noise, Vibration, and Reverberation," The Journal of the Acoustical Society of America, vol. 28, No. 5, Sep. 1956, pp. 966-972.
Zwicker et al., "Das Ohr als Nachrichtenempänger [The ear as message receiver]," S. Hirzel Verlag Stuttgart, 1967, pp. 118-149 and pp. 178-184.
J.W.S. Rayleigh, "The Theory of Sound," New York Dover Publications, vol. 2, 2nd Edition Revised and Enlarged, pp. 116-118, Jun. 1976.
S. Haykin, "Adaptive Filter Theory," Prentice Hall Information and System Sciences Series, 4th Edition, pp. 320-341 and 436-463, 2002.
Meyer et al., "Effect of Acoustic Reflections on Directional Localization and Loudness of Speech," Third Physical Institute, University of Göttingen, Math-phys. Cl. 6, pp. 31-42, 1952.
Verifications of Translation.
Meyer et al. "Multi-Channel Speech Enhancement in a Car Environment Using Wiener Filtering and Spectral Subtraction", 1997 IEEE International Conference on Acoustics, Speech, and Signal Processing, vol. 2, pp. 1167-1170, Apr. 21, 1997.
Fuchs et al. "Noise Suppression for Automotive Applications Based on Directional Information", Acoustics, Speech, and Signal Processing, vol. 1, pp. 237-240, May 17, 2004.

* cited by examiner

SYSTEM FOR IMPROVING COMMUNICATION IN A ROOM

CLAIM OF PRIORITY

This patent application claims priority to European Patent Application serial number 06 010 757.0 filed on May 24, 2006.

FIELD OF THE INVENTION

The invention relates to a system for improving communication in a room and in particular to reducing feedback and improving the perception of direction in a room communication system, for example, a passenger compartment communication system of a motor vehicle.

RELATED ART

In order to improve speech comprehensibility in motor vehicles, passenger compartment communication systems may be used. Such systems are capable of improving the comprehensibility of speech when conversations are being conducted in the moving motor vehicle, that is, for example, in the case of the simultaneous effect of motion noise from the motor vehicle itself or external noise sources in the vehicle's surroundings. This applies, in particular, when one of the participants (interlocutors) in the conversation is in one of the front seats and another participant is in one of the rear seats and there is relatively high level of noise. FIG. 1 illustrates an overview of such a system.

FIG. 1 illustrates a passenger compartment communication system that includes a loudspeaker-room-microphone (LRM) system which, as in the present case, may include the passenger compartment of a car. In this embodiment, the LRM system has, by way of example, four seating positions for passengers, which are designated driver, front-seat passenger, rear left seating position $R_L$ and rear right seating position $R_R$. Depending on the design of the car, additional seats or additional rows of seats may also be present. The LRM system illustrated in FIG. 1 also comprises loudspeakers $L_{FL}$ (front left), $L_{FR}$ (front right), $L_{RL}$ (rear left) and $L_{RR}$ (rear right) which form the sound reproduction system.

Passenger compartment communication systems, particularly in luxury cars, are typically of complex design and comprise a plurality of loudspeakers and groups of loudspeakers at various positions in the passenger compartment, use also typically being made, inter alia, of loudspeakers and groups of loudspeakers for different frequency ranges (for example subwoofers, woofers, medium-tone speakers and tweeters etc.). As shown in FIG. 1, the LRM system also comprises a number of microphones that are respectively assigned in groups to the seating positions for the passengers; by way of example, there are two respective microphones for each seat in FIG. 1. Using a plurality of microphones for each seating position allows, for example, for optimizing the directivity of recorded speech signals for the respective seating position and thus optimizing the sound source which is to be recorded.

Signal processing components are used to filter, amplify, attenuate, and/or change the phase angle of or temporally delay, inter alia, the speech signals recorded at the different seating positions using the microphones or groups of microphones, before they are reproduced using the passenger compartment communication system, to achieve the desired auditory impression. The speech signals traveling from the rear to the front and from the front to the rear are often treated differently.

Using such systems for passenger compartment communication, the speech signal of the person who is speaking at the time is recorded using one or more microphones assigned to this person's seat and, after appropriate signal processing, is reproduced using those on-board loudspeakers of the passenger compartment communication system that are situated in the vicinity of the remaining passengers. A typical passenger compartment communication system comprises a multiplicity of loudspeakers or groups of loudspeakers that are respectively arranged, for example, on the front, middle and rear sides and, if appropriate, also in the center of the passenger compartment of a motor vehicle and can be individually controlled. A disadvantage of such a technique is that the acoustic localization and the visual localization of the speaker do not match in this case, particularly for passengers who are in rows of seats other than that of the respective speaker (for example, the speaker in the driver's seat, and the listener in one of the rear seats), since the speech signal of the speaker is predominantly received from loudspeakers that are respectively situated in the immediate vicinity of the listener. In addition, without appropriate signal processing of these speech signals, which is interposed between the recording and reproduction of the speech signals, such a system may become unstable do to acoustic feedback as undesirable feedback noise (for example whistling) which may be very loud, no longer decays and is reproduced using the loudspeakers of the passenger compartment communication system may occur.

If a plurality of microphones are assigned to each seat in the corresponding passenger compartment communication system for the purpose of recording the speech signals, a beamformer output signal is calculated from this plurality of microphone signals for each of these seats. Before being reproduced using the loudspeakers of the passenger compartment communication system, the signals are then processed to remove the echo and feedback components, using adaptive filters. In addition, the output volume of the speech signal that has been reproduced is continuously adaptively matched to the background noise level in the passenger compartment.

Several techniques are known for reducing the effects of the described feedback effects on the quality of speech reproduction. The first technique involves suppressing feedback and the second technique involves compensating for feedback by estimating the pulse response of the loudspeaker-room-microphone system (LRM system). Both approaches are compared below.

FIG. 2 illustrates a system for suppressing feedback using an adaptive filter. In this case, the system in FIG. 2 comprises a LRM system but, for reasons of clarity of the subsequent description, it is reduced in this case to a loudspeaker 20, a speaker position 22 and a microphone 23. FIG. 2 also illustrates a signal processing path for suppressing feedback, which comprises an adaptive filter c(n) 24 and a delay element $z^{-ND}$ 25. The output signal from the adaptive filter c(n) is subtracted from the microphone signal y(n) at summing element 26, thus generating signal u(n) on line 27 for controlling the loudspeaker 20. At the same time, the signal u(n) is used to adapt the filter coefficients of the adaptive filter c(n) which has the delay line $z^{-ND}$ connected upstream of it, as shown in FIG. 2. The input signal of the delay line $z^{-ND}$ is generated by a summer 28, as shown in FIG. 2, from the sum ($\Sigma_2$ in FIG. 2) of the microphone signal y(n), which has been multiplied by a factor of $1-\alpha$, and the output signal from the adaptive filter c(n), which has been multiplied by a factor of α. In this case, the factor a may assume any desired values between 0 and 1.

In this case, IIR filters or FIR filters are typically used as adaptive filters. FIR filters are characterized in that they have a finite pulse response and operate in discrete time steps that are usually determined by the sampling frequency of an analog signal. An FIR filter is present if the quantity a has the value 0 in FIG. 2, that is to say if no output values u(n) which have already been calculated are concomitantly included in the calculation of a new output value. Such an FIR filter of the $N_c$-th order is described in this case using the following difference equation:

$$u(n) = c_0 * y(n) + c_1 * y(n-1) + c_2 * y(n-2) + \ldots + c_{N_c-1} * y(n-N_C) = \sum_{i=0}^{N_C} c_i * y[n-i]$$

$$u(n) = y(n) - (c_0 * y(n-N_D) + \ldots + c_{N_C-1} * y(n-N_D-N_C+1))$$

where u(n) is the output value at the time n and is calculated from the sum of the $N_c$ last sampled input values $y(n-N_D-N_C+1)$ to $y(n-N_D)$, which sum has been weighted with the filter coefficients $c_i$. In this case, the desired transfer function is implemented by adaptively determining the filter coefficients $c_i$. In this case, the set of filter coefficients c(n) (see FIG. 2) at each sampling time n is composed of the individual filter coefficients $c_0$ to $c_{N_c-1}$.

In contrast to FIR filters, output values that have already been calculated are also concomitantly included in the calculation (recursive filter, $\alpha \neq 0$ in FIG. 2) in the case of IIR filters and the latter are characterized in that they have an infinite pulse response.

In this case, in contrast to FIR filters, IIR filters may be unstable but have higher selectivity with the same implementation complexity. In practice, that filter which, taking into account the requirements and the associated computation complexity, best satisfies the requisite requirements is selected.

The FIR filter used when $\alpha=0$ is selected (see FIG. 2) is, in this case, an adaptive filter which is set, using a suitable adaptation technique, for example the Normalized Least Mean Squares (NLMS) algorithm, in such a manner that the power of the output signal u(n) is minimized.

If feedback then occurs at a particular frequency, this particular frequency is attenuated by the adaptive feedback suppression filter and the energy at reproduction levels are reduced in this frequency range. Referring to FIG. 2, this is possible as long as the reciprocal of the feedback frequency or an integer multiple of it is greater than $N_D$ sampling cycles and less than $N_D+N_C$ sampling cycles. In this case, the parameter $N_C$ denotes, as described above, the length of the FIR filter (the number of samples used to calculate an output value u(n)) and the parameter $N_D$ denotes the delay of the input signal by $N_D$ sampling cycles (see delay of $z^{-ND}$ in FIG. 2).

It is necessary to delay the input signal by $N_D$ cycles before the actual filtering operation, otherwise the short-term correlation of the speech signal would not be taken into account. As a result, the spectral envelope of the speech signal would be filtered out of the reproduced signal in such a case, and a very unnatural sound would be produced. In this case, a delay of approximately 2 ms is sufficient to avoid this undesirable behavior when filtering speech signals. In addition, on account of the periodicity of speech signals, the "memory" of an adaptive FIR filter ($\alpha=0$ in FIG. 2) must not be too large, in particular it must not be selected to be larger than the reciprocal of the speech fundamental frequency to be expected. For this reason, the filter should comprise no more than 80 to 120 coefficients or samples $N_C$ (at a sampling rate of 16 kHz) which are used for the calculation.

Since speech signals also contain components that have been correlated in short time ranges, the adaptive filter structure shown in FIG. 2 also tries to suppress these components. This undesirable behavior may be largely prevented if only a small maximum permissible step size μ is permitted for the change in the filter coefficients during adaptation. In this case, only those periodic signal components that are present in the speech signal for a relatively long period of time are removed. On the other hand, a small step size results in slow convergence, that is to say slow adaptation of the adaptive filter to rapid changes in the signal to be processed. Therefore, sudden interference is also suppressed only after a period of time that cannot be ignored and can be perceived by human hearing. For this reason, an appropriate compromise must be included in the step size μ for changing the filter coefficients during adaptation to obtain an acoustic signal that is optimized with respect to human hearing sensitivities for a range of realistic ambient conditions that is as wide as possible. In this case, step sizes μ in the range of from 0.00001 to 0.01 have proved to be expedient for the exemplary case of using the NLMS algorithm for adaptively adapting the FIR filter.

The FIR structure of the feedback suppression filter may be extended using a weighted feedback path (see FIG. 2). Varying the feedback gain α makes it possible, in the extreme case, to convert the filter from a pure FIR structure ($\alpha=0$) to a pure oscillator ($\alpha=1$), it also being possible to select any desired values a between 0 and 1 (IIR filter). Inserting the feedback path is motivated by the fact that an attempt is made to profit from the advantages of a noise compensator having a periodic reference signal. The extension makes it possible to implement considerably more narrowband attenuation than with a pure FIR structure. On the other hand, the adaptive behavior of the filter may result in an unstable filter being produced (see IIR filter). In order to prevent this, complicated stability tests must be carried out in such a case after each adaptation step. When implemented in real applications, only the FIR filter structure ($\alpha=0$) is therefore frequently used in order to avoid instability in the filter structure.

In addition, adaptive feedback suppression filters have another quite considerable disadvantage. As soon as oscillation is detected at a particular frequency, the adaptive filter will attenuate the signal components at this frequency as determined. As a result, the levels of the spectral components that are responsible for the feedback are reduced in the loudspeaker signal u(n) to such an extent that feedback no longer occurs, which, for the time being, represents the desired behavior. This suppression consequently also results in the feedback initially disappearing from the microphone signal, as desired. However, this in turn results in the attenuation of the signal components being adaptively reversed again in the relevant frequency range and in the feedback gaining power again. As soon as this has happened, the adaptive filter adjustment process begins again for these spectral components, and a type of oscillation of the attenuation response of the adaptive filter consequently results. Although feedback is suppressed in this manner, this does not take place durably or continuously to the desired extent.

Conventionally, use is therefore made of a further arrangement and a further method for reducing feedback. These are so-called compensation filters which have similar functional features to echo compensation in hands-free telephones. The structure of such an arrangement is illustrated, by way of example, in FIG. 3. The system illustrated in FIG. 3 comprises a LRM system 30, a loudspeaker 32, a speaker position 34 and a microphone 36. FIG. 3 also illustrates a speaker signal s(n) and the pulse response h(n) of the transmission path between the loudspeaker 32 and the microphone 36. FIG. 3 also includes the basic structure of a signal processing path for compensating for feedback, this signal processing path comprising an adaptive filter $\hat{h}(n)$ 38 and a summing element 40. As shown in FIG. 3, the adaptive filter $\hat{h}(n)$ 38 is used in this case to generate a feedback signal $\hat{d}(n)$ from the signal x(n) for controlling the loudspeaker 32. In addition, as shown in FIG. 3, output signal $\hat{d}(n)$ on line 42 from the adaptive filter $\hat{h}(n)$ is subtracted from the microphone signal y(n) at the summing element 40, thus generating an error signal e(n) on line 44 for adapting the filter coefficients of the adaptive filter $\hat{h}(n)$ 38.

In this case, the adaptive filter $$\hat{h}(n)=[\hat{h}_0(n),\hat{h}_1(n),\ldots,\hat{h}_{N_H-1}(n)]^T$$

is used to attempt to estimate the pulse response h(n) of the transmission path between the loudspeaker 32 and the microphone 36. Convoluting the loudspeaker signal x(n) with the estimated pulse response allows estimation of the feedback signal $\hat{d}(n)$. The aim in this case is for the estimation $\hat{h}(n)$ of the pulse response of the loudspeaker-room-microphone system to effectively match the real pulse response h(n) of the transmission path between the loudspeaker 32 and the microphone 36. If this is the case, the overall system can be decoupled by subtracting the estimated feedback signal $\hat{d}(n)$ on the line 42 from the microphone signal y(n).

However, feedback compensation proves to be particularly difficult in practice since adaptation of the filter h(n) is disrupted by the great correlation between the excitation signal x(n) for the loudspeaker and the local signal s(n) from the speaker 34 (the speaker signal is, of course, likewise reproduced by the loudspeaker 32):

$$E\{x(n)s(n+1)\}\neq 0$$

Adaptive algorithms that converge towards the so-called Wiener solution attempt to achieve the following solution during the convergence process:

$$\hat{H}_{opt}(\Omega)=\frac{S_{xy}(\Omega)}{S_{xx}(\Omega)}=H(\Omega)+\frac{S_{xs}(\Omega)}{S_{xx}(\Omega)}$$

In this case, the variables $S_{xy}(\Omega)$, $S_{xs}(\Omega)$ and $S_{xx}(\Omega)$ denote the cross-power density spectra between the signals x(n) and y(n) and between x(n) and s(n) and also the autopower density spectrum of the signal x(n). It should be taken into account that this does not represent the desired solution $$\hat{H}_{opt}(\Omega)=H(\Omega)$$

For this reason, adaptation is usually carried out only when the short-term power of the excitation signal falls (whenever the person who is speaking pauses for a short moment). During this time, the correlation between the excitation signal x(n) and the feedback component in the microphone signal is considerably larger than the correlation between the excitation signal x(n) and the otherwise prevailing local speech signal s(n).

Furthermore, the background noise that is usually present can be replaced with artificially generated background noise during pauses in speech. In this case too, the cross-correlation between the excitation signal x(n) and the local signal s(n) is considerably reduced. However, in such situations, the signal-to-noise ratio is then also very small, for which reason adaptation can be carried out only with very small step sizes. Another possible way of reducing cross-correlation is afforded by non-linearities that are inserted into the loudspeaker path. However, these non-linearities then also have an adverse effect on the reproduction of audio signals that is effected using the same loudspeaker system. If the great technical efforts made to optimize audio signal reproduction in motor vehicles are taken into account in this case, this procedure cannot be considered as a realistic way of compensating for the feedback in the passenger compartment communication systems in motor vehicles.

Thus, a combination of all the techniques presented above is used in most contemporary systems to reduce cross-correlation. Nevertheless, during real operation, it is often possible to identify only the pulse response in those frequency ranges that have pronounced feedback. As a result of the poor matching at the remaining frequencies, feedback compensators often generate quiet but nevertheless audible artifacts that may be perceived to be unpleasant.

There have previously been only a few systems for passenger compartment communication. All of the known examples of techniques for suppressing or compensating for feedback have the disadvantage that either the adaptation of an adaptive filter, is disrupted by the nature and correlation of the signals to be processed or undesirable oscillation in the attenuation response of the adaptive filters is caused, for example, by the method of operation. These and other artifacts, for example the filtering ability (which is restricted to high-level feedback) of the passive noise reduction systems which are present according to the prior art or the fact that the acoustic localization and the visual localization of a speaker do not match, constitute considerable disadvantages of the known systems.

There is a need for improved adaptation of the filtering techniques, which do not have the above-mentioned disadvantages.

SUMMARY OF THE INVENTION

Active noise compensation is combined with the use of psycho-acoustic effects spatial hearing to effect considerably higher stability of the electro-acoustic feedback loops, a reduction in artifacts and an improvement in the matching between acoustic localization and the visual localization of a speaker.

A system for improving the acoustical communication between interlocutors in a room comprises at least two positions where the interlocutors are to be located in the room; at least one microphone located in the vicinity of each of the interlocutor positions in the room for generating electrical signals representative of acoustical signals present at the respective interlocutor positions; at least one loudspeaker located in the room for converting electrical signals into acoustical signals; and a signal processing unit connected to the microphone(s) and loudspeaker(s), amplifying each of the electrical signals provided by the microphones and supplying the amplified microphone signals to the at least one loudspeaker. The signals from the microphones to the loudspeaker are each delayed by the signal processing unit with a delay time such that the acoustical signal arriving first at one of the interlocutor positions originates from the direction of the other interlocutor position.

DESCRIPTION OF THE DRAWINGS

The invention can be better understood with reference to the following drawings and description. The components in the figures are not necessarily to scale, instead emphasis being placed upon illustrating the principles of the invention. Moreover, in the figures, like reference numerals designate corresponding parts. In the drawings.

DETAILED DESCRIPTION

The system described below uses a combination of active noise compensation techniques and psycho-acoustic effects of spatial hearing as described below.

When designing and parameterizing passenger compartment communication systems, the psycho-acoustic effects associated with the spatial hearing sensitivities of the sound signals presented, particularly speech signals in the present case, are taken into account, in addition to the suppression of, or compensation for, feedback, in the course of communication between passengers in different seating positions in the passenger compartment of a motor vehicle. As desired, a match between the acoustic localization and the visual localization of the respective speaker is intended to be achieved. This applies, in particular, to the rear-seat passengers since they see the front-seat passengers in front of them but the localization (which is triggered by the acoustic localization) of the front-seat passengers seems to take place behind the rear-seat passengers if the loudspeakers are situated, for example, on the parcel shelf of the passenger compartment.

A mismatch between different sensory impressions (i.e., visual and acoustic) may give rise to a unnatural impression of the conversation. In reaction to such a mismatch between acoustic and visual sensory impressions, some people may feel nauseous. To avoid this, the gain of the rear loudspeakers may be limited on the basis of the temporal delay between the sounds of the loudspeaker output and the direct sound from the person who is speaking. In this case, the maximum permissible gain up to which there is still no mismatch between the sensory impressions is described by the so-called law of the first wavefront. This psycho-acoustic effect is also referred to as the Haas effect and is described in detail, for example, in H. Haas: The Influence of a Single Echo on the Audibility of Speech, Journal of the Audio Engineering Society, Vol. 20, pages 145-159, March 1972.

Figure 4:
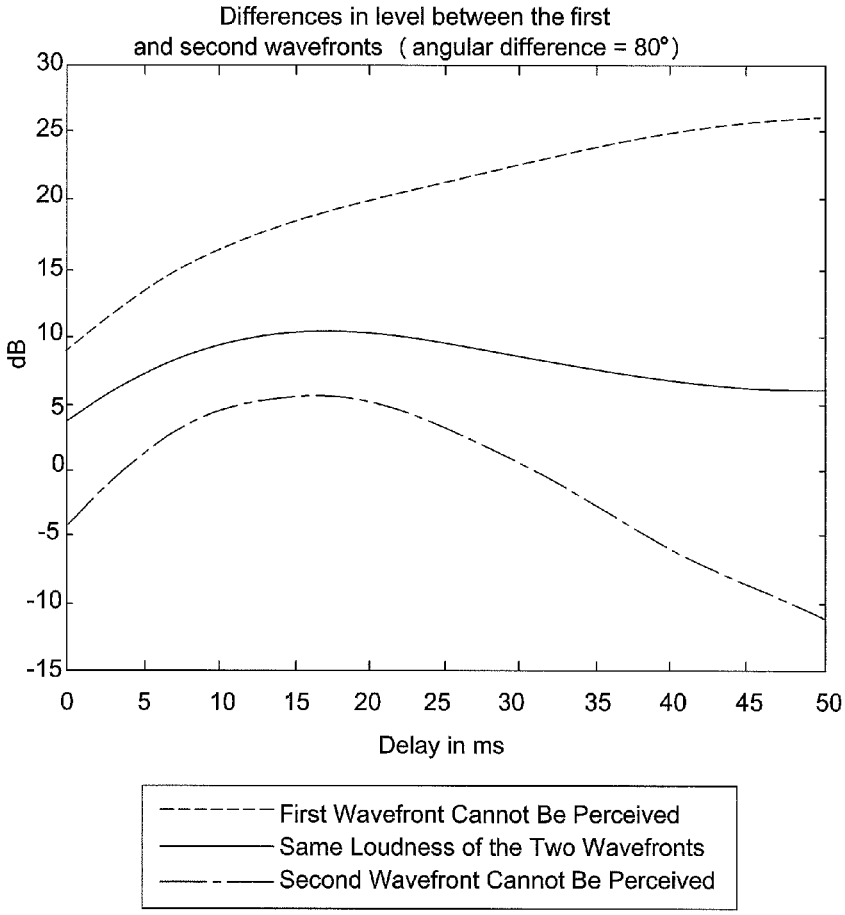
FIG. 4 is a graphical illustration of the relationship between the loudness of different loudspeaker signals and source localization.

FIG. 4 graphically illustrates the results of a psycho-acoustic investigation into directional localization and the perceived volume of speech in loudspeaker performance (see E. Meyer, G. R. Schodder: Über den Einfluss von Schallrückwürfen auf Richtungslokalisation und Lautstärke bei Sprache [The effect of sound reflection on directional localization and volume in speech], Nachrichten der Akademie der Wissenschaften in Göttingen, Math-phys. Cl. 6, pages 31-42, 1952). In this case, FIG. 4 illustrates the results of psycho-acoustic test series in which test subjects were to adjust the perceived volume of the identical loudspeaker signals from two separate loudspeakers, which were at an equal distance from the test subject, on the basis of prescribed criteria, one of the two loudspeaker signals being reproduced with a time offset with respect to the second loudspeaker signal and this delay time between the two loudspeaker signals being additionally varied in the test series. In this case, the differences in level (in dB), which were set, on average, by the test subjects on the basis of particular prescribed criteria, between the two loudspeaker signals, which were reproduced with a time offset with respect to one another, are plotted against the delay time (in ms) in performance between these two signals.

In this case, two loudspeakers were respectively placed at an angle of 40° and −40° in front of a test subject. Both loudspeakers reproduced the same previously recorded signal, one of the loudspeaker signals being output with a time delay of a few milliseconds (abscissa in FIG. 4). During the test, twenty test subjects were successively asked to adjust the gain of that loudspeaker which output the signal with a time delay in such a manner that:

- the same loudness of the two loudspeaker signals was perceived (continuous line in FIG. 4),
- the signal from the loudspeaker with no delay was no longer be perceived (dashed line in FIG. 4), and
- the signal from the loudspeaker with a delay was no longer be perceived (dash-dotted line in FIG. 4).

The terms volume and loudness used in this context relate to the same psycho-acoustic sensitivity variable and differ only in their units. They take account of the frequency-dependent sensitivity of human hearing. The psycho-acoustic variable loudness (see E. Zwicker and R. Feldtkeller, Das Ohr als Nachrichtenempfänger [The ear as a message receiver], S. Hirzel Verlag, Stuttgart, 1967) indicates how loud a sound event at a particular level, with a particular spectral composition and for a particular duration is perceived to be subjectively.

In this case, the loudness is doubled when a sound is perceived to be twice as loud and thus allows different sound events to be compared with respect to the perceived volume. The unit for assessing and measuring loudness is the sone in this case. A sone is defined as the perceived volume of a sound event of 40 phons, that is to say the perceived volume of a sound event which is perceived to be as loud as a sinusoidal tone at the frequency of 1 kHz with a sound pressure level of 40 dB.

At medium and high volumes, an increase in the volume by 10 phons results in the loudness being doubled. At low volumes, even a minor increase in volume results in the perceived loudness being doubled. In this case, the volume perceived by a person depends on the sound pressure level, the frequency spectrum and the behavior of the sound over time.

As can be seen in FIG. 4, it is possible, with a delay of, for example, 15 ms, to increase the volume level of the loudspeaker, which reproduces the otherwise identical signal with a time delay, by approximately 10 to 12 dB without shifting the localization of the signal in the direction of the loudspeaker which is thus louder. These results, which are taken from E. Meyer, G. R. Schodder: Über den Einfluss von Schallrückwürfen auf Richtungslokalisation und Lautstärke bei Sprache [The effect of sound reflection on directional localization and volume in speech], Nachrichten der Akademie der Wissenschaften in Göttingen, Math-phys. Cl. 6, pages 31-42, 1952, in this case effectively match the conditions prevailing in passenger compartments of cars.

If high-quality systems for improving passenger compartment communication in motor vehicles are not intended to adversely affect acoustic localization (that is to say are not intended to change spatial localization), the law of the first wavefront (the Haas effect described above) defines an upper limit for the maximum gain. This applies only in those cases in which this value is less than the maximum permissible gain. This is generally the case in high-quality passenger compartment communication systems in large, top of the line vehicles where the limitation of the maximum possible amplification of a signal by the Haas effect is effective more quickly than the limitation on the basis of the stability of the overall system.

If the gain limited by the Haas effect does not suffice to distinctly improve the speech quality and the speech comprehensibility, the sound from the direction of the primary sound source must be amplified in a suitable manner (the person who is speaking at the time would have to speak louder) or additional loudspeakers which emit from the direction of the primary sound source (the person who is speaking) must be used for the perceived gain of the primary sound source. The latter case is a subject matter of the present invention in addition to the feedback suppression (described below) using active noise reduction methods.

The first investigations into the superimposition of sound waves were carried out by Lord Rayleigh as early as 1878 (RAYLEIGH, LORD (1878): "The Theory of Sound", Vol. II, Chapter XIV, x282: "Two Sources of Like Pitch; Points of Silence; Experimental Methods", MacMillan & Co, London etc., 1st ed. 1877/78: pp. 104-106; 2nd ed. 1894/96 and Reprints (Dover, N.J.): pp. 116-118). On account of the complexity of the technical requirements for active noise suppression, particularly complex noise, a physically realistic approach to active noise suppression was described for the first time in 1933 (LUEG, P. (1933): "Verfahren zur Dämpfung von Schallschwingungen." [Method for attenuating sound oscillations] German Patent No. 655 508.). In this case, Lueg already described the use of electro-acoustic components to suppress noise but successful laboratory experiments in this respect were not carried out until 20 years later (OLSON, H. F. (1953): "Electronic Sound Absorber" U.S. Pat. No. 2,983,790 and OLSON, H. F. (1956): "Electronic Control of Noise, Vibration, and Reverberation." J. Acoust. Soc. Am. 28, 966-972). Nevertheless, on account of the range of technology needed, it was not yet possible at this time to implement actual applications.

Known methods and arrangements are intended to suppress or reduce emitted noise (ANC systems) or attenuate undesirable noise by generating extinction waves and superimposing them on the undesirable noise. The amplitude and frequency content of the extinction waves are essentially the same as that of the undesirable noise, but their phase is simultaneously shifted through 180 degrees with respect to the undesirable noise. Ideally, this completely extinguishes the undesirable noise. This effect of reducing the sound level of noise in a desirable manner is frequently also referred to using the term destructive interference.

In the case of active noise suppression or noise compensation methods in passenger compartments of cars, the aim is to use additional loudspeakers or groups of loudspeakers to generate a so-called anti-noise field (see, for example, S. M. Kuo, D. R. Morgan: Active Noise Control Systems: Algorithms and DSP Implementations, John Wiley & Sons, New York, 1996) having the above-mentioned features. Such an approach can also be applied to the present problems of undesirable feedback in a passenger compartment communication system, as described below in FIG. 5.

Figure 5:
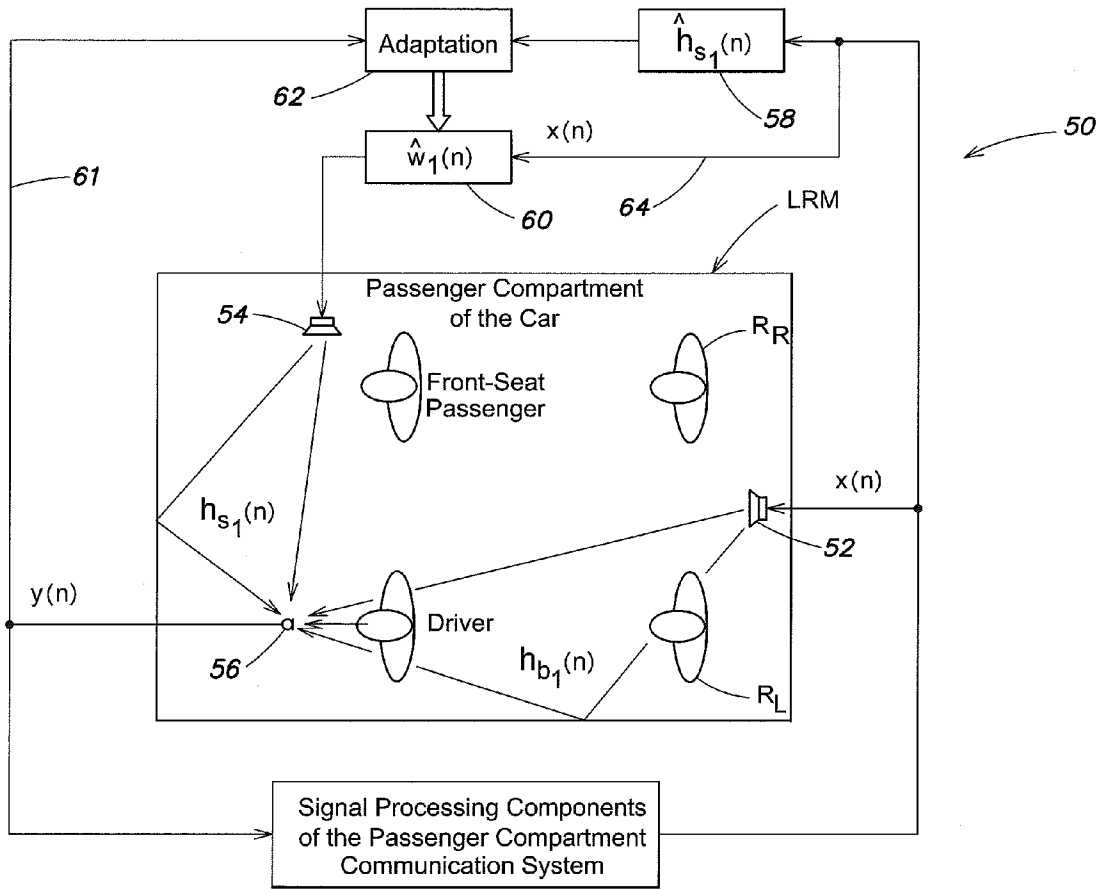
FIG. 5 is a block diagram illustration of a single-channel system for active feedback compensation.

FIG. 5 is a block diagram illustration of a loudspeaker-room-microphone system which, in one embodiment, is the passenger compartment of a motor vehicle. For ease of illustration, the illustration of the multiplicity of loudspeakers, which are typically present in such a passenger compartment, was again limited to a rear loudspeaker 52 that belongs to the passenger compartment communication system and a loudspeaker 54, which is also fitted to the existing passenger compartment communication system, thus resulting in a single-channel system 50 for active feedback compensation as shown in FIG. 5.

Figure 1:
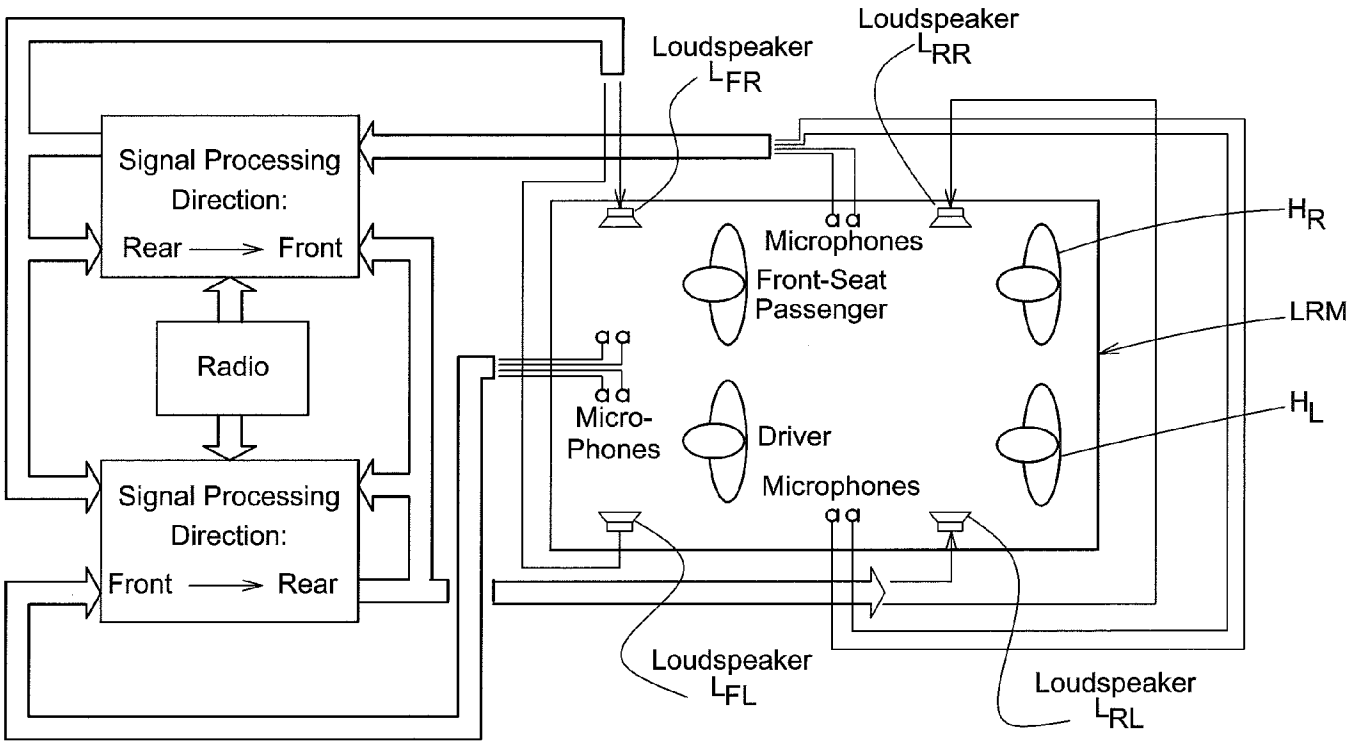
FIG. 1 is a block diagram illustration of a passenger compartment communication system.
Figure 2:
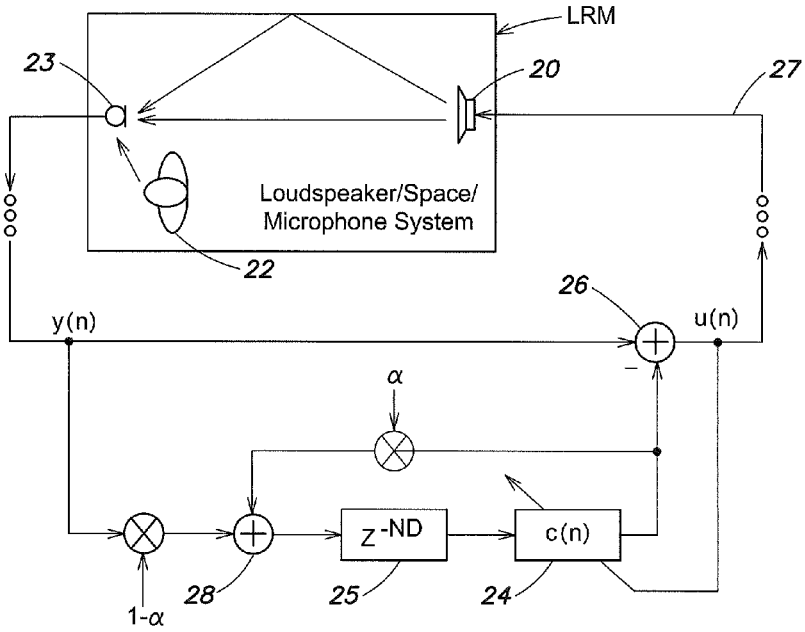
FIG. 2 illustrates an arrangement for suppressing feedback.
Figure 3:
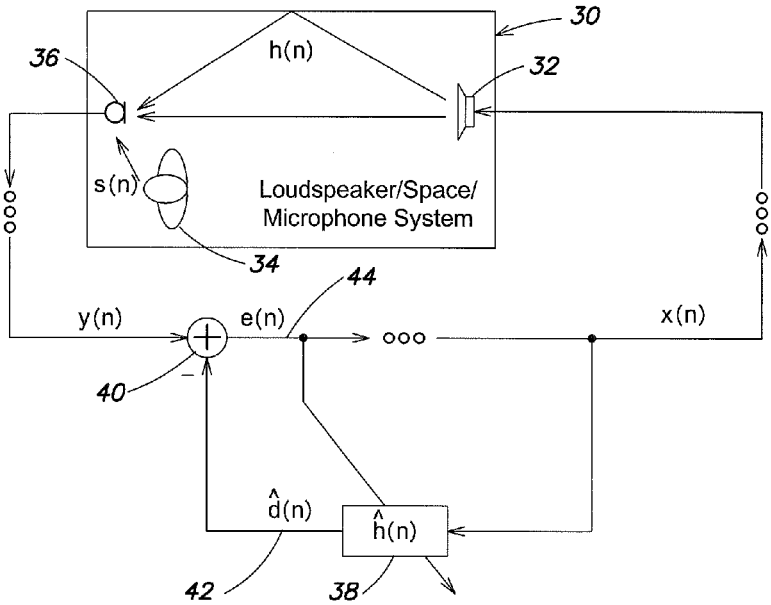
FIG. 3 illustrates an arrangement for compensating for feedback.

FIG. 5 also illustrates the seating positions for passengers as well as an exemplary microphone 56 from a multiplicity of microphones (not shown) in the passenger compartment. The seating positions are known from FIG. 1 and are designated driver, front-seat passenger, rear left seating position $R_L$ and rear right seating position $R_R$. Depending on the design of the car, additional seats or additional rows of seats having further seats may also be provided in this case. FIG. 5 also indicates the pulse response $h_{b_1}(n)$ of the transmission path between the rear loudspeaker $L_R$ and the microphone M and the pulse response $h_{s_1}(n)$ between the additional loudspeaker 54 and the microphone 56. As can be gathered from the arrows for the sound paths in FIG. 5, the acoustic reflections that arise in a passenger compartment of a car are also concomitantly included and taken into account in these pulse responses in this case.

Referring still to FIG. 5, signal processing components of the passenger compartment communication system include, a filter $\hat{h}_{s_1}(n)$ 58, an adaptive filter $\hat{w}_1(n)$ 60 and coefficient filter logic 62 for adapting the filter coefficients of the adaptive filter $\hat{w}_1(n)$. In this case, signal y(n) on line 61 provided by the microphone 56 is processed by the signal processing components of the passenger compartment communication system and is used, in the form of signal x(n) on line 64 to control the rear loudspeaker 52. At the same time, the microphone signal y(n) on the line 61 and the loudspeaker signal x(n) on the line 64, as filtered by the filter $\hat{h}_{s_1}(n)$, are used by the filter coefficient logic to control the adaptation of the filter coefficients of the adaptive filter $\hat{w}_1(n)$. The loudspeaker signal x(n) on the line 64 filtered by this adaptive filter $\hat{w}_1(n)$ is reproduced using the additional loudspeaker 54 in the LRM system.

When the driver is speaking, the rear loudspeaker outputs the driver's microphone signal y(n), which has been converted into the signal x(n) on the line 64 by the signal processing components of the passenger compartment communication system, in order to improve the comprehensibility of the driver's speech signals for the rear-seat passengers. However, in this type of signal reproduction, there is also feedback to the driver's microphone 56 via the passenger compartment of the car. This signal transmission can be described, to a good approximation, by convoluting the signal x(n) on the line 64 with the pulse response $h_{b_{1,i}}(n)$. Assuming linear time-invariant systems, the following thus results, in the frequency domain, for the feedback components of the sound signal:

$$F(e^{j\Omega}) = X(e^{j\Omega})H_{b_1}(e^{j\Omega})$$

The use of prefiltering by the adaptive filter $\hat{w}_{1,i}(n)$ before output using the additional loudspeaker 54 reduces the undesirable sound field of the feedback components at the microphone 56, that is to say $$X(e^{j\Omega})\left(H_{b_1}(e^{j\Omega}) + \hat{W}_1(e^{j\Omega})H_{s_1}(e^{j\Omega})\right) = 0$$

The transfer function denotes transmission from the additional loudspeaker 54 to the driver's microphone via the passenger compartment of the vehicle. As can be discerned from the equation above, an adaptation technique must be used to attempt to set the coefficients of the adaptive filter $\hat{w}_{1,i}(n)$ in such a manner that:

$$W_1(e^{j\Omega}) = \frac{H_{b_1}(e^{j\Omega})}{H_{s_1}(e^{j\Omega})}$$

In this case, virtually all common techniques, for example the NLMS algorithm, affine projection methods or the RLS method, may be used as adaptation methods (also see, in this respect, S. Haykin: Adaptive Filter Theory, 4th edition, Prentice Hall, Englewood Cliffs, N.J., 2002). The transfer function $H_{s_1}(e^{j\Omega})$ in the denominator of the above equation proves to be problematic in this case in the real application of the technique. Should the z transform of this pulse response have zeros outside the unit circle or in the unit circle, the optimal solution according to $$X(e^{j\Omega})\left(H_{b_1}(e^{j\Omega}) + \hat{W}_1(e^{j\Omega})H_{s_1}(e^{j\Omega})\right) = 0$$

represents an unstable filter. In order to avoid this, the so-called filtered xLMS algorithm is frequently used. In this case, a previously filtered variant rather than the input signal x(n), that is to say the loudspeaker signal from the rear loudspeaker 52 itself, is used to calculate the filter correction (adaptation of the filter coefficients). In this case, prefiltering should ideally be carried out with the pulse response $$\hat{h}_{s_1,i}(n) = h_{s_1,i}(n)$$

For further details on active noise suppression techniques, reference is made to S. M. Kuo, D. R. Morgan: Active Noise Control Systems: Algorithms and DSP Implementations, John Wiley & Sons, New York, 1996.

In addition to feedback suppression, an active arrangement, as illustrated in FIG. 5, has additional advantages for improving comprehensibility in passenger compartments of vehicles, including:

- Outputting speech signals from the driver using the additional side loudspeaker 54, which is positioned in the vicinity of the front-seat passenger, also improves comprehensibility for the front-seat passenger.
- The front-seat passenger loudspeaker 54 additionally provides, for the rear-seat passengers, a sound source that likewise emits signals from the front. This increases the primary wavefront for the Lombard effect (change in the voice in loud surroundings), and greater amplification of the sound signals is possible (while simultaneously retaining the correct acoustic perception of direction).
- If the driver's microphone is situated in the vicinity of the driver, the sound which is added in phase opposition and is intended to extinguish the undesirable sound components—at least at low frequencies—also improves the driver's perception of echoes.

The advantages of the two techniques described are combined below. In this case, it should be taken into consideration that the results obtained and described here may also be applied to the opposite conditions, that is to say when the front-seat passenger is speaking and the remaining passengers are listening.

Figure 6:
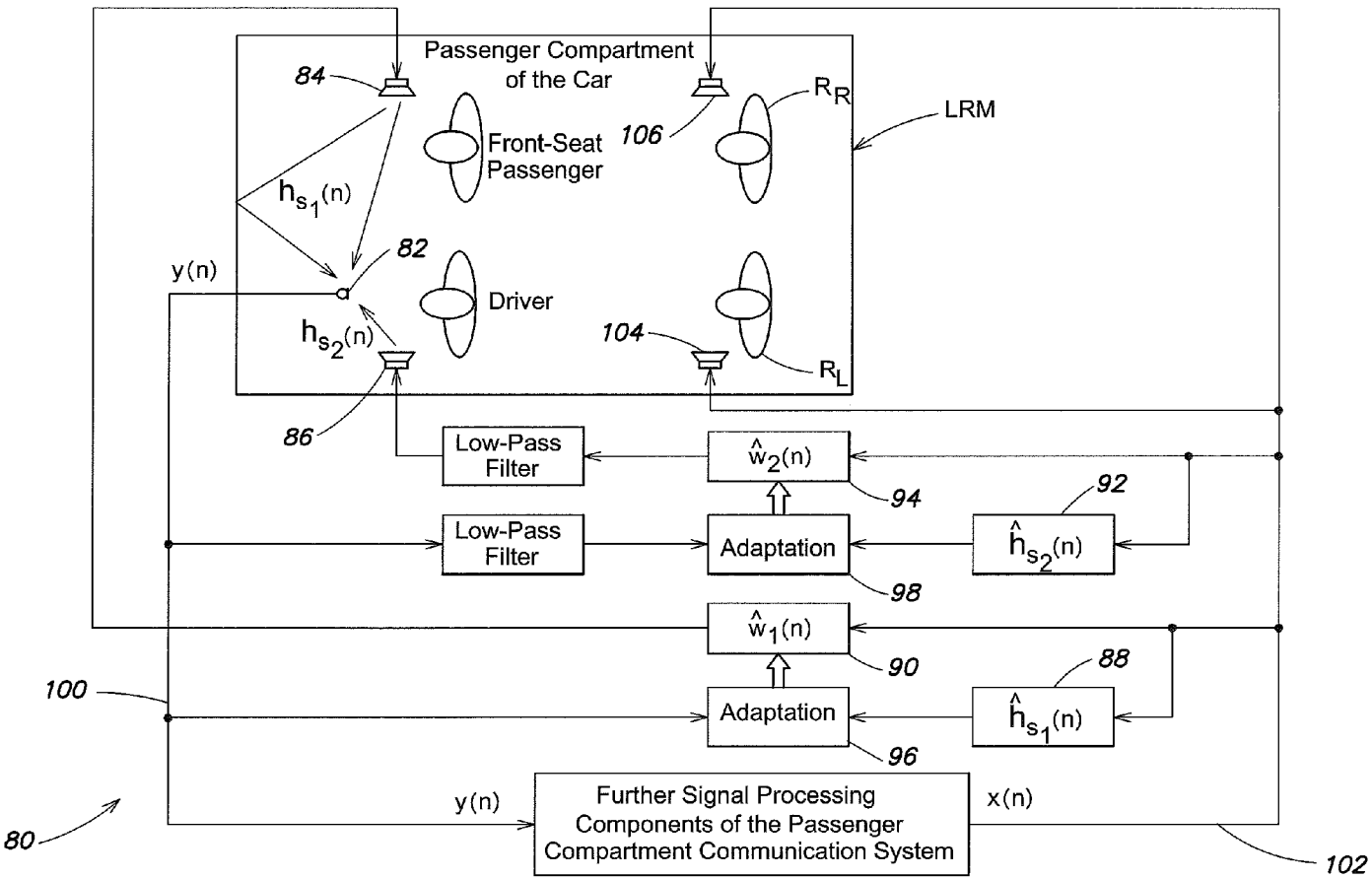
FIG. 6 is a block diagram illustration of a system for suppressing feedback and improving the perception of direction.

The two effects and techniques previously described may be combined in this case, according to an aspect of the invention, in such a manner to achieve both greater amplification of the desired sound signals (without violating the law of the first wavefront) and active suppression or compensation of acoustic feedback in an arrangement. FIG. 6 shows the arrangement (which is used for this purpose) employing the combination of techniques, which is based on the structure of the arrangement shown in FIG. 5.

FIG. 6 is a block diagram illustration of a LRM system 80 which, in one embodiment, is located in the passenger compartment of a motor vehicle. FIG. 6 illustrates the seating positions for passengers, are designated driver, front-seat passenger, rear left seating position $R_L$ and rear right seating position $R_R$, as well as a microphone 82 from a plurality of microphones in the passenger compartment. The system of FIG. 6 also includes a pulse response $h_{s_1}(n)$ of the transmission path between a loudspeaker 84 on the front-seat passenger's side and the microphone 82 and the pulse response $h_{s_2}(n)$ between a loudspeaker 86 on the driver's side and the microphone 82.

The LRM system 80 includes signal processing components of the passenger compartment communication system, a first filter $\hat{h}_{s_1}(n)$ 88, a first adaptive filter $\hat{w}_1(n)$ 90, a second filter $\hat{h}_{s_2}(n)$ 92, a second adaptive filter $\hat{w}_2(n)$ 94 and coefficient adaption units 96, 98 associated with the adaptive filters $\hat{w}_1(n)$ and $\hat{w}_2(n)$, respectively. In this case, signal y(n) on line 100 from the microphone 82 is processed by the signal processing components and is used, in the form of signal x(n) on line 102, to control left-hand and right-hand loudspeakers 104, 106 in the rear part of the passenger compartment (rear seat). In addition, the microphone signal y(n) on the line 100 and the loudspeaker signal x(n) on the line 102, as filtered by the first filter $\hat{h}_{s_1}(n)$ 88, are used to control the adaptation of the filter coefficients of the first adaptive filter $\hat{w}_1(n)$ 90. The loudspeaker signal x(n) on the line 102 as filtered by this first adaptive filter $\hat{w}_1(n)$ 90 is reproduced using the loudspeaker 84. In addition, as shown in FIG. 6, the microphone signal y(n) on the line 100 and the loudspeaker signal x(n) on the line 102, which has been filtered by the second filter $\hat{h}_{s_2}(n)$ 92, are used to control the adaptation of the filter coefficients of the second adaptive filter $\hat{w}_2(n)$ 94. The loudspeaker signal x(n) on the line 102 which has been filtered by this second adaptive filter $\hat{w}_2(n)$ 94 is reproduced using the loudspeaker 86.

In addition to the loudspeaker 84 on the front-seat passenger's side, the loudspeaker 86 (which may be fitted in the driver's door) may also be used to improve localization and to improve active feedback compensation. The use of this loudspeaker affords an additional sound source in the immediate vicinity of the speaker (the driver in the present example). With respect to the Haas effect described further above, this means that the primary sound source of the speech signal in the passenger compartment can be amplified, and an even greater resultant gain is possible, without changing the impression of the direction, that is to say the localization. However, when setting the adaptive filters, it must be taken into account in the present embodiment that a plurality of anti-noise loudspeakers and channels are now used. This mainly makes it necessary to commonly standardize the adaptation step size (for example see S. M. Kuo, D. R. Morgan: Active Noise Control Systems: Algorithms and DSP Implementations, John Wiley & Sons, New York, 1996).

The additional loudspeaker in the vicinity of the person speaking cannot be used in this case as in conventional active noise compensation applications since the person who is speaking would perceive their own speech signal as a clear echo. For this reason, the magnitude of the transfer function $W_2(e^{j\Omega})$ must be limited to a value that prevents the perception of one's own speech signal which arrives after a time delay. The same applies to outputting the speaker's signal on the front-seat passenger's side but the upper limit may be selected in this case to be larger than on the speaker's side (the distance between the loudspeaker 84 on the front-seat passenger's side and the speaker on the driver's side is considerably larger than the corresponding distance between the loudspeaker 86 on the driver's side and the speaker who is the driver in the present example).

Since echoes are perceived to be considerably less disruptive at low frequencies and a longer delay time before such echoes arrive is tolerated and, in addition, the performance of active noise and feedback compensation techniques is considerably better at low frequencies, it is desirable to restrict the signals that have been reproduced to their low-frequency signal components on that side of the passenger compartment which is in the vicinity of the speaker. For this reason, low-pass filters are respectively integrated in the signal output or adaptation path in the vicinity of the speaker, as shown in FIG. 6. The selection of the cut-off frequency of these low-pass filters depends on the geometry of the passenger compartment of the car and, in particular, on the distance between the loudspeakers and the ears of the person who is speaking and on the distance between the microphones and the ears of the person who is speaking and on the associated sound propagation times.

In this case, the pulse responses $\hat{h}_{s_1,i}(n)$ and $\hat{h}_{s_2,i}(n)$ needed for signal prefiltering may either already be measured in advance or may be adaptively determined during use of processing of the invention. The last-mentioned variant is to be preferred in this case since the seating positions or the number of passengers, for example, are unknown in advance. Since ambiguity arises when directly identifying the pulse responses using the output signals from the passenger compartment communication system (for details see E. Hänsler, G. Schmidt: Acoustic Echo and Noise Control, John Wiley & Sons, New York, 2004), it is advantageous to use the pulse responses which are estimated, for example, when compensating for radio signals. Such a technique is described, for example, in G. Schmidt, T. Haulick, H. Lenhardt: Enthallung der Wiedergabe von Audiosignalen in Fahrzeugen mit Insassenkommunikationsanlagen [Dereverberating the reproduction of audio signals in vehicles having passenger communication systems], notification of invention P05051, January 2005.

Rather than using individual loudspeakers, arrays of loudspeakers may be employed. In this case, a double loudspeaker in the driver's door, for example, may be controlled using suitable prefiltering in such a manner that emission in the direction of the driver is as low as possible but relatively large emitted power and thus compensation for the undesirable signal components are achieved in the direction of the recording microphone.

An advantageous effect of systems employing the processing techniques of the present invention results from the use of noise compensation techniques which are active, for example, but not limited to Active Noise Cancellation (ANC) techniques, thus resulting in increased stability of the technique when reducing undesirable feedback and, overall, in an increase in the possible reproduction level.

Further advantages may also result if, as a result of the use of psycho-acoustic effects in the type and distribution of signal reproduction using the loudspeakers of a passenger compartment communication system, matching between the visual localization and the acoustic localization of a speaker is improved.

Yet further advantages may also result if, as a result of the appropriate deliberate and additional use of individual loudspeakers, for example a side loudspeaker, the comprehensibility of speech signals is enhanced, for example for a front-seat passenger.

Yet further advantages may likewise also result if, as a result of active noise compensation, the perception of echoes is also improved.

Although various examples to realize the invention have been disclosed, it will be apparent to those skilled in the art that various changes and modifications can be made which will achieve some of the advantages of the invention without departing from the spirit and scope of the invention. It will be apparent to those reasonably skilled in the art that other components performing the same functions may be suitably substituted. Such modifications to the inventive concept are intended to be covered by the appended claims.

What is claimed is:

1. A system for improving the acoustical communication between interlocutors in a room comprising:

a first microphone located in the vicinity of a first interlocutor in the room for generating a first sensed signal adjacent to the first interlocutor;

a second microphone located in the vicinity of a second interlocutor in the room for generating a second sensed signal adjacent to the second interlocutor;

at least one loudspeaker located in the room for converting electrical signals into acoustical output signals; and a signal processing unit that receives and processes the first and second sensed signals, and provides processed microphone signals to the at least one loudspeaker;

where the processed microphone signals are each time delayed by the signal processing unit such that the acoustical output signal arriving at the first interlocutor is perceived by the first interlocutor to originate from the direction of the second interlocutor.

2. The system of claim 1, where the signal processing unit amplifies the first and second sensed microphone signals by a limited amount such that the level of signals not originating from the direction of the other interlocutor position exceeds the level of signals originating from the direction of the other interlocutor position by less than a given level difference.

3. The system of claim 1, where at least two loudspeakers are arranged in the room; and the signal processing unit amplifying and delaying each of the first and second sensed signals such that the acoustical signal arriving first at one of the interlocutor positions originates from the direction of the other interlocutor position.

4. The system of claim 3, where in the signal processing unit, the amplification of the respective first or second sensed signal is limited for each of the loudspeakers separately such that the level of signals not originating from the direction of the other interlocutor position exceeds the level of signals originating from the direction of the other interlocutor position by less than a given level difference.

5. The system of claim 2, where the given level difference is a function of the delay time.

6. The system of claim 1, further comprising an additional loudspeaker that receives a noise cancellation signal from a noise processor unit; the noise cancellation signal representing the phase-inverted noise signal in the vicinity of the microphone.

7. The system of claim 6, where the additional loudspeaker is arranged perpendicular to the main axis of the microphone or at least one of the microphones.

8. The system of claim 6, where the additional loudspeaker is arranged in the vicinity of at least one of the interlocutor positions.

9. The system of claim 6, where the noise processor unit comprises an adaptive filter that receives signals from the at least one microphone and the at least one loudspeaker and generates the noise cancellation signal by extracting the noise signal in the vicinity of the microphone and inverting the phase.

10. The system of claim 9, where the adaptive filter comprises one of the (i) the NLMS algorithm, (ii) affine projection methods, (iii) the RLS method or (iv) the filtered xLMS algorithm.

11. The system of claim 6, where the noise processor unit comprises a filter having a transfer function whose magnitude is limited to a given value.

12. The system of claim 11, where the noise processor unit comprises a low pass filter unit in the signal path between the one of the microphones and the one of the loudspeakers.

13. A method for improving the acoustical communication between interlocutors in at least two positions in a room, the method comprising the steps of:

sensing an acoustical signal adjacent to a first interlocutor in the room and providing a first sensed signal indicative thereof;

sensing an acoustical signal adjacent to a second interlocutor in the room and providing a second sensed signal indicative thereof;

amplifying the first sensed signal to provide a first amplified signal and amplifying the second sensed signal to provide a second amplified signal;

converting the amplified first and second signals into acoustical signals;

where the first and second sensed signals are each time delayed such that the acoustical signal arriving first at one of the interlocutor positions originates from the direction of the other interlocutor position.

14. The method of claim 13, where the amplification of the respective electrical signal is limited such that the level of signals not originating from the direction of the other interlocutor position exceeds the level of signals originating from the direction of the other interlocutor position by less than a given level difference.

15. The method of claim 13, where the acoustical signals converted from the amplified and delayed electrical signals are radiated in at least two positions in the room; the amplifying and delaying step is applied to each of the electrical signals generated; and the amplified and delayed electrical signals are radiated at each radiating position such that the acoustical signal arriving first at one of the interlocutor positions originates from the direction of the other interlocutor position.

16. The method of claim 15, where the amplification of the respective electrical signals representative of acoustical signals present at the respective interlocutor positions is limited for each of the radiating position separately such that the level of signals not originating from the direction of the other interlocutor position exceeds the level of signals originating from the direction of the other interlocutor position by less than a given level difference.

17. The method of claim 16, where the given level difference is depending on the delay time.

18. The method of claim 13, where at least one additional radiating position is arranged in the room, the method further comprising the step of radiating at the additional position a noise cancellation signal where the noise cancellation signal represents the phase-inverted noise signal in the vicinity of the respective interlocutor position.

19. The method of claim 18, where the at least one additional radiating position is arranged perpendicular to the main axis of the position or at least one of the position where the electrical signal representative of acoustical signals present at the respective interlocutor positions is picked up.

20. The method of claim 18, where at least one of the additional radiating positions is arranged in the vicinity of at least one of the interlocutor positions.

21. The method of claim 18, further comprising the steps of:

adaptive filtering of signals from the at least one microphone and the at least one loudspeaker; and generating the noise cancellation signal by extracting the noise signal in the vicinity of the interlocutor positions and inverting the phase.

22. The method of claim 21, where the adaptive filtering is performed based upon one of the NLMS algorithm, affine projection methods, the RLS method or the filtered xLMS algorithm.

23. The method of claim 22, where the adaptive filtering comprising a filer whose transfer function has a magnitude limited to a given value.

* * * * *